US006268692B1

(12) United States Patent
Yokota et al.

(10) Patent No.: US 6,268,692 B1
(45) Date of Patent: Jul. 31, 2001

(54) CATHODE RAY TUBE WITH CONTOURED ENVELOPE

(75) Inventors: Masahiro Yokota; Yuuichi Sano, both of Fukaya (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/191,196

(22) Filed: Nov. 13, 1998

(30) Foreign Application Priority Data

Nov. 14, 1997 (JP) ..... 9-313435

(51) Int. Cl.[7] ..... H01J 31/00
(52) U.S. Cl. ..... 313/477 R; 220/2.1 A
(58) Field of Search ..... 313/477 R, 440; 220/2.1 A, 2.1 R, 2.3 A

(56) References Cited

U.S. PATENT DOCUMENTS 3,731,129 5/1973 Tsuneta et al. ..... 313/64
3,806,750 4/1974 Tsuneta et al. ..... 313/64
5,258,688 * 11/1993 Fondrk ..... 313/447 R
5,801,481 9/1998 Yokota .
5,962,964 * 10/1999 Sano et al. ..... 313/440
6,002,203 * 12/1999 Yokota et al. ..... 313/477

FOREIGN PATENT DOCUMENTS 2033159 11/1970 (FR) .
48-85030 11/1973 (JP) .

* cited by examiner

*Primary Examiner*—Ashok Patel
*Assistant Examiner*—Matthew J. Gerike
(74) *Attorney, Agent, or Firm*—Pillsbury Winthrop LLP

(57) ABSTRACT

A vacuum envelope of a cathode ray tube includes a rectangular panel having an inner surface where a substantially rectangular phosphor screen is formed, a neck in which an electron gun is provided, and a funnel connected between the panel and the neck. The funnel has a first portion having a large diameter and positioned on the phosphor screen side, and a substantially truncated quadrangular pyramid-like second portion positioned on the neck side. From the second portion to the neck, a deflection yoke is mounted on the outer surface of the funnel. Where the vacuum envelope is cut along a plane including a tube axis, the shapes of the cross-sections of the first and second portions have an inflection point at the boundary between the first and second portions. The end of the deflection yoke on the phosphor screen side is positioned near the inflection point.

5 Claims, 4 Drawing Sheets

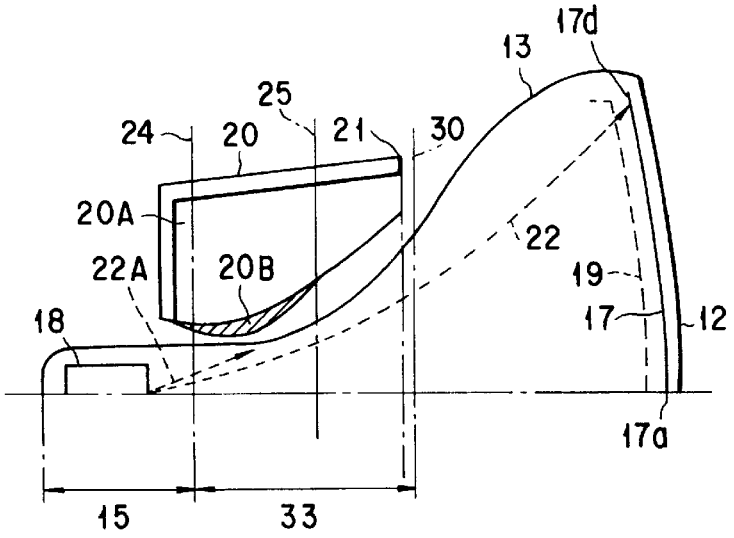
FIG. 3
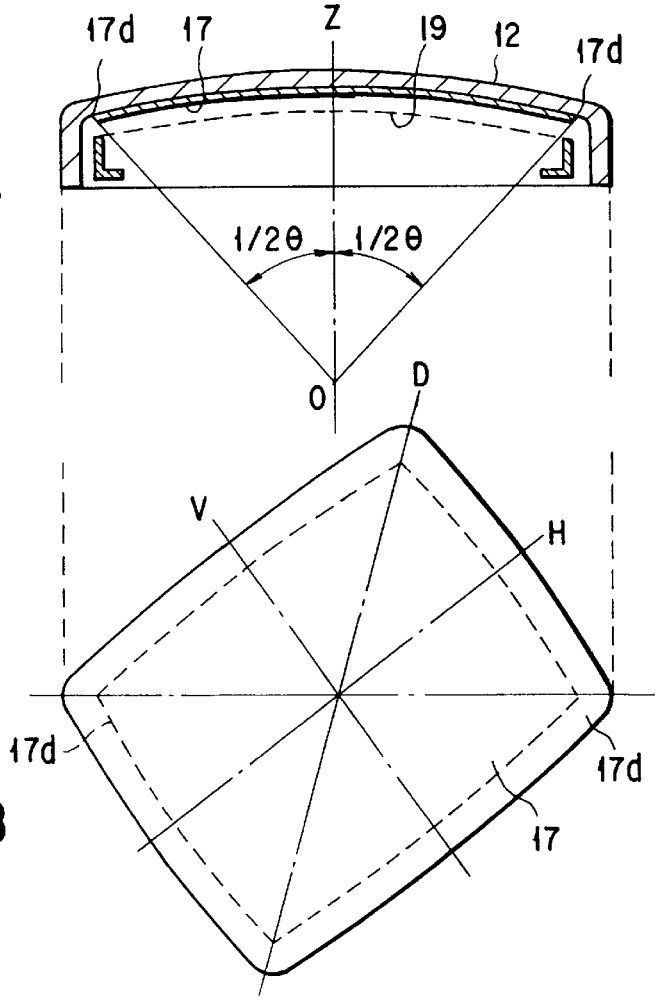
FIG. 4A
FIG. 4B

CATHODE RAY TUBE WITH CONTOURED ENVELOPE

BACKGROUND OF THE INVENTION

The present invention relates to a cathode ray tube such as a color picture tube or the like.

A color cathode ray tube generally has a vacuum envelope comprising a glass-made face panel having a substantially rectangular display portion, a glass-made funnel joined to the face panel, and a cylindrical glass-made neck joined to the funnel. An electron gun which emits three electron beams is provided in the neck. A deflection yoke is mounted on the outside of the vacuum envelope so as to bridge from the outer circumference of the neck to the outer circumference of the funnel. The funnel has a small-diameter portion extending from the joint portion joined to one end of the deflection yoke, which is so-called a yoke mount portion.

On the inner surface of the face panel is formed a phosphor screen comprising dot-like or stripe-like phosphor layers which radiate in blue, green, and red. In the vacuum envelope, a shadow mask is provided to oppose the phosphor screen, and a number of electron beam passage apertures are formed in the shadow mask.

With the color cathode ray tube, electron beams emitted from the electron gun are deflected in the horizontal and vertical directions by horizontal and vertical deflection magnetic fields generated from the deflection yoke, and horizontally and vertically scan the phosphor screen through the shadow mask, thereby displaying a color image.

Color cathode ray tubes of a self-convergence inline type have been widely used as a kind of cathode ray tube as described above. In this kind of cathode ray tube, the electron gun is formed as an in-line type electron gun which emits three electron beams disposed on one same horizontal plane. Further, three in-line electron beams emitted from the electron gun are deflected by a horizontal deflection magnetic field of a pin-cushion type generated from the deflection yoke and a vertical deflection magnetic field of a barrel type, thereby to converge the three electron beams arranged to be in-line over the screen without requiring any special correction means.

In this cathode ray tube, since the deflection yoke is a source which consumes a large power, it is important to reduce the power consumption of the deflection yoke for the purpose of reducing the power consumption of the entire cathode ray tube. Specifically, to increase the screen luminance, the cathode voltage which finally accelerates the electron beams must be increased. In addition, the deflection frequency must be increased to respond to OA devices such as a HD (High Definition), a PC (Personal Computer), and the like, and leads to an increase of the deflection power.

Meanwhile, as for OA devices such as a PC and the like which are operated by an operator near a cathode ray tube, regulations concerning a leakage magnetic field which leaks from the deflection yoke to outside of the cathode ray tube have been strengthened. As a measure of reducing the magnetic field leaking from the deflection yoke, there has been a generally known method of adding a compensation coil. However, by thus adding a compensation coil, the power consumption of the PC is increased accordingly.

In general, to reduce the deflection power and the leakage magnetic field, the neck diameter of the cathode ray tube as well as the outer diameter of the yoke mount portion of the funnel to which a deflection yoke is mounted must be decreased so that the effective area of deflection magnetic fields is reduced and the deflection magnetic fields efficiently act on electron beams.

However, in a cathode ray tube, electron beams pass near the inner surface of the yoke mount portion of the funnel. Therefore, if the neck diameter and the outer diameter of the yoke mount portion are reduced much more, electron beams deflecting toward corner portions of the phosphor screen at a maximum deflection angle collide into the inner wall of the yoke mount portion, so that regions into which electron beams do not collide are generated on the phosphor screen. It is therefore difficult to reduce the deflection power by reducing the neck diameter or the outer diameter of the yoke mount portion much more.

If electron beams are kept colliding into a portion of the inner wall of the yoke mount portion, the temperature of this portion increases so that glass forming the funnel is melted, resulting in a risk of implosion of the vacuum envelope.

As a measure for solving the problems as described above, Japanese Patent Application KOKOKU Publication No. 48-34349 (corresponding to U.S. Pat. No. 3,731,129) discloses that the yoke mount portion of the funnel on which a deflection yoke is mounted is formed in a shape whose lateral cross-sections gradually change from a circular shape in the neck side to a substantially rectangular shape in the panel side, that is, formed in a pyramid-like shape. This structure is based on an idea that the electron beam passing area inside the yoke mount portion has a substantially rectangular shape when a rectangular raster is drawn on the phosphor screen.

If the yoke mount portion of the funnel is thus formed in a pyramid-like shape, the diameter of the deflection yoke attached to the outside of the mount portion can be reduced in directions of the long axis (or horizontal axis: axis H) and the short axis (or vertical axis: axis V). Therefore, horizontal and vertical deflection coils of the deflection yoke are arranged to be close to electron beams, and the electron beams can be efficiently deflected. As a result, the deflection power can be reduced.

However, as the lateral cross-section of the yoke mount portion of the funnel becomes rectangular to reduce efficiently the deflection power as described above, those portions of the yoke mount portion that are close to ends of the horizontal axis and to ends of the vertical axis become flat and may be easily deformed in the tube axis direction due to the load of the atmospheric pressure. Therefore, the strength of the vacuum envelope against the atmospheric pressure is lowered so that safety is lost.

Prevention of reflection of outer light on the surface of the face panel and easy view of images have been strongly demanded, and hence, flattening of the face panel has been required. However, since flattening of the face panel involves deterioration of the strength of the vacuum envelope, it is difficult to maintain strength sufficient for safety if the funnel having a yoke mount portion in a form of a pyramid-like shape is directly used as described above.

From the reasons as described above, there has conventionally been a problem that the yoke mount portion cannot be formed to be rectangular enough to reduce the deflection power sufficiently, or the yoke mount portion formed in a rectangular shape cannot be applied to a flat face panel. Therefore, with conventional techniques, it is difficult to manufacture a cathode ray tube which achieves both of sufficient strength against the atmospheric pressure and sufficient reduction of the deflection power.

As for techniques of forming the yoke mount portion into a pyramid-like shape, the present applicant produced two series, one of which provided a deflection angle of 110° and a neck diameter of 36.5 mm in panel sizes of diagonal lengths of 18", 20", 22", and 26", and the other of which provided a deflection angle of 110° and a neck diameter of 29.1 mm in panel sizes of diagonal lengths of 16" and 20", in 1970 or so. In those days, the outer surface of the panel is substantially spherical and the radius of curvature is as about 1.7 times large as the effective diameter of the screen, and the face panel is applied to a 1R tube. However, as for a cathode ray tube in which the outer surface of the panel has a radius of curvature which is as two or more times large as the effective diameter of the screen, its relationship with the shape of the yoke mount portion has not been apparent in relation to the bulb strength.

BRIEF SUMMARY OF THE INVENTION

The present invention has been made to solve the problem as described above, and has an object of providing a cathode ray tube capable of efficiently reducing a deflection power and of satisfying requirements for high luminance and high-frequency deflection while maintaining sufficient strength of a vacuum envelope against the atmospheric pressure.

To achieve the above object, a cathode ray tube according to the present invention comprises:

a vacuum envelope made of glass and including a substantially rectangular panel having an inner surface on which a substantially rectangular phosphor screen is formed, the phosphor screen having a horizontal axis and a vertical axis passing through a tube axis and being perpendicular to each other, a substantially cylindrical neck, and a funnel connected between the neck and the panel and having a first portion positioned on a side of the panel and a second portion positioned on a side of the neck and formed in a shape of a substantially truncated quadrangular pyramid, the panel, the funnel, and the neck being arranged along the tube axis;

an electron gun provided in the neck, for emitting electron beams to the phosphor screen; and a deflection yoke mounted on an outer surface of the vacuum envelope to extend from the second portion of the funnel to the neck, and having a deflection coil for deflecting the electron beams emitted from the electron gun to scan the phosphor screen;

wherein supposing that a tube-axis coordinate z is given in a direction in which a side of the phosphor screen is positive along the tube axis and that a distance between the tube axis and the outer surface of the funnel, where the vacuum envelope is cut along a plane including the tube axis, is r(z), the second portion of the funnel has a shape which is convex toward the tube axis so as to provide a positive value by twice differentiating r(z) by the tube-axis coordinate z, and supposing that a boundary between the second and first portions is an inflection point at which the value provided by twice differentiating r(z) by the tube-axis coordinate z is zero, at least one cross-section perpendicular to the tube axis in an area of the second portion where the deflection yoke is provided has a non-circular shape which maximizes a distance from the tube axis, at a portion between the horizontal axis and the vertical axis, and;

in a cross-section of the vacuum envelope cut along the plane including the tube axis, the boundary between the second and first portions is positioned near an end portion of the deflection coil on the side of the phosphor screen.

Further, a cathode ray tube according to the present invention comprises:

a vacuum envelope made of glass and including a substantially rectangular panel having an inner surface on which a substantially rectangular phosphor screen is formed, the phosphor screen having a horizontal axis and a vertical axis passing through a tube axis and being perpendicular to each other, a substantially cylindrical neck, a funnel connected between the neck and the panel and having a first portion positioned on a side of the panel and a second portion positioned on a side of the neck and formed in a shape of a substantially truncated quadrangular pyramid, the panel, the funnel, and the neck are disposed along the tube axis;

an electron gun provided in the neck, for emitting electron beams to the phosphor screen; and a deflection yoke mounted on an outer surface of the vacuum envelope and extending from the second portion of the funnel to the neck, and having a deflection yoke for deflecting the electron beams emitted from the electron gun to scan the phosphor screen; wherein supposing that a deflection reference position is a point on the tube axis, at which an angle between the tube axis and a line connecting an end of the phosphor screen in a diagonal axis direction thereof, with the tube axis between the phosphor screen and the electron gun is ½ of a maximum deflection angle of the cathode ray tube, and that LA, SA, and DA are respectively diameters of the cross-section in a horizontal axis direction, a vertical axis direction, and a diagonal axis direction of the phosphor screen, all of the cross-sections perpendicular to the tube axis in an area from the deflection reference position to the boundary position between the second and first portions, in the vacuum envelope, satisfy a relation of DA>LA or DA>SA.

According to the cathode ray tube constructed in a structure as described above, when the yoke mount portion of the funnel is formed in a shape as described above, the strength of the yoke mount portion as well as the strength the vacuum envelope are improved. It is therefore possible to use a substantially pyramid-like yoke mount portion, so that the deflection power can be effectively reduced and requests for high luminance and high-frequency deflection can be satisfied.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1 to 8 show a color cathode ray tube according to an embodiment of the present invention, in which:

FIG. 1 is a perspective view of the cathode ray tube viewed from the back side thereof;

FIG. 2 is a cross-sectional view showing a cross-section of a yoke mount portion, which is perpendicular to the tube axis;

FIG. 3 is a view schematically showing an half of a cross-section where the vacuum envelope of the cathode ray tube is cut along a plane including the tube axis and a diagonal axis of the panel;

FIGS. 4A and 4B are cross-sectional views and a plane view of the panel portion and explain the position of the deflection center of the cathode ray tube;

FIG. 5 is a graph showing a relationship between the rectangular level of the yoke mount portion and the deflection power;

FIG. 6 is a view for explaining a stress caused when an external force acts on the yoke mount portion;

FIG. 7 is a view schematically showing an half of a cross-section of the cathode ray tube including the tube axis and a diagonal axis of the panel; and FIG. 8 is a view schematically showing the outer contours of longitudinal cross-sections where the cathode ray tube is cut along a plane including the tube axis and horizontal axis, a plane including the tube axis and vertical axis, and a plane including the tube axis and a diagonal axis.

DETAILED DESCRIPTION OF THE INVENTION

In the following, a color cathode ray tube according to an embodiment of the present invention will be described with reference to the accompanying drawings.

Figure 1:
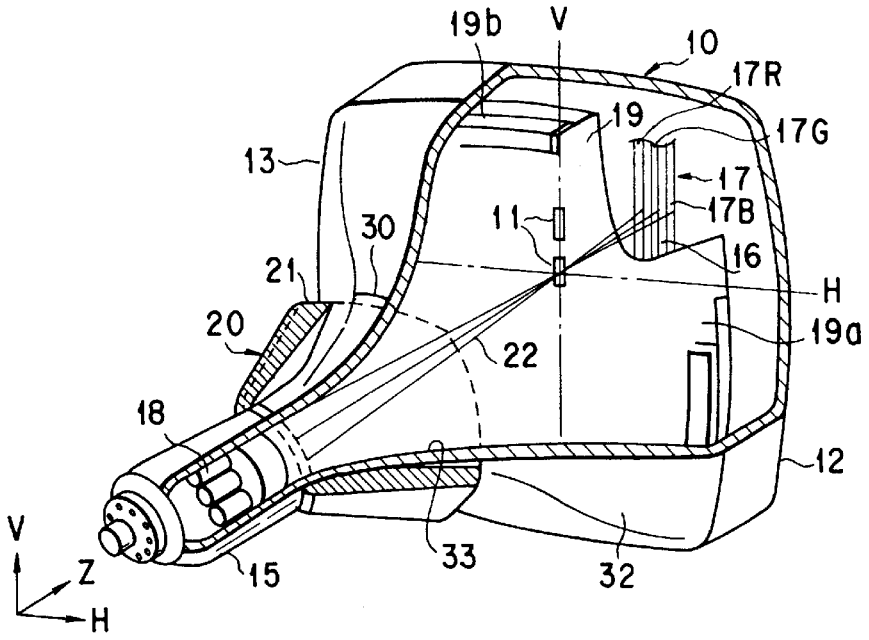

As shown in FIG. 1, a color cathode ray tube comprises a vacuum envelope 10 made of glass. The vacuum envelope 10 has a substantially rectangular panel 12 having an inner surface on which a substantially rectangular phosphor screen 17 is formed, a funnel 13 joined to the panel 12, and a cylindrical neck 15 extending from the funnel. The panel 12, the funnel 13, and the neck 15 are disposed along a tube axis Z. The panel 12 is formed in a substantially rectangular shape having a horizontal axis H and a vertical axis V which pass through the tube axis Z and are perpendicular to each other.

The funnel 13 includes a first portion 32 having a large diameter and positioned on the panel 12 side and a second portion 33 having a substantially truncated quadrangular pyramid-like shape and positioned on the neck 15 side. The second portion 33 constitutes a so-called yoke mount portion. A deflection yoke 20 is mounted on the outside of the funnel 13 and extends from the second portion 33 to the neck 15. The deflection yoke 20 is formed by integrating deflection coils, described later, with a frame.

The phosphor screen 17 is formed of stripe-like three-color phosphor layers 17B, 17G, and 17R which radiate in blue, green, and red, and stripe-like light shielding layers 16 formed between the phosphor layers. A shadow mask 19 is provided in the vacuum envelope 10 and is opposed to the phosphor screen 17. The shadow mask 19 comprises a substantially rectangular mask body 19*a* having a number of electron beam apertures 11, and a mask frame 19*b* supporting the circumferential edge portion of the mask body. The shadow mask 19 is supported on the panel 12 in a manner in which elastic support members not shown but fixed to the mask frame 19*b* are engaged with stud pins projecting from the skirt portion of the panel 12.

An electron gun 18 which emits three electron beams 22 is arranged in the neck 15. The three electron beams 22 emitted from the electron gun 18 are deflected by horizontal and vertical magnetic fields generated from the deflection yoke 20 so as to scan horizontally and vertically the phosphor screen 17 through the shadow mask 19, thereby displaying a color image.

The present inventors have found an optimum shape of the funnel, which achieves a low deflection power and sufficient strength, under the consideration of deflection characteristics, a vacuum stress, and various experiments in case where the second portion 33 of the funnel 13 and the deflection yoke 20 are formed in a substantially truncated quadrangular pyramid-like shape.

Figure 2:
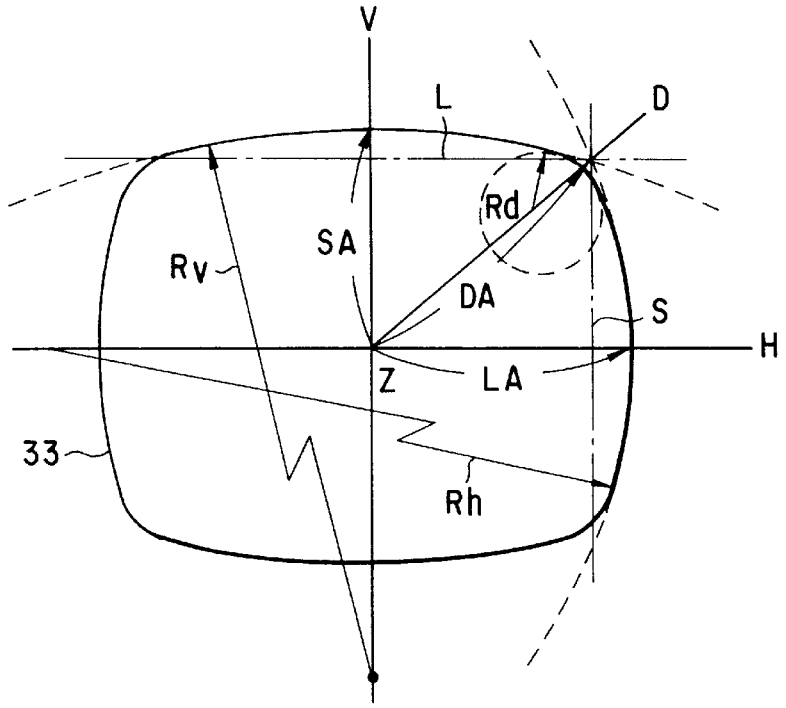

FIG. 2 shows the outer contour of a cross-section, perpendicular to the tube axis Z, of the second portion (which will be hereinafter referred to as a yoke mount portion) 33 formed in a substantially truncated quadrangular pyramid-like shape. In the cross-section, distances from the tube axis Z to the outer contour of the yoke mount portion 33 are denoted by LA, SA, and DA along the horizontal axis H of the phosphor screen 17, the vertical axis V thereof, and a diagonal axis D of the yoke mount portion 33, respectively. The distances LA and SA are each smaller than the distance DA, and accordingly, the portions of the deflection coil located at the ends of the horizontal axis and at the ends of the vertical axis can be positioned close to the electron beams, so that the deflection power can be reduced. Note that the diagonal axis direction of the cross-section, having the maximum diameter, corresponds to the diagonal axis direction of the phosphor screen 17 but does not strictly correspond thereto sometimes.

In directions other than the three axis directions described above, the outer contour of the above cross-section is defined by connecting an arc having a center on the horizontal axis H and a radius Rh, an arc having a center on the vertical axis V and a radius Rv, and an arc having a center near the diagonal axis D and a radius Rd. Otherwise, various mathematical expressions may be used to define a substantially rectangular cross-section. The center of the arc having the radius Rd is substantially near the diagonal axis D of the phosphor screen 17 but need not always correspond to the diagonal axis D.

As the outer contour of the yoke mount portion 33 approximates to a rectangle, the deflection power is reduced more but the strength of the vacuum envelope 10 is deteriorated, as described previously. Hence, the following is set as an index expressing the rectangular level.

$$(LA+SA)/(2DA) \tag{1}$$

In case of using a conventional conical yoke mount portion, each of LA and SA is equal to DA, and therefore, the index value of the rectangular level is 1. In contrast, in case where the yoke mount portion 33 is formed in a truncated quadrangular pyramid-like shape, DA is substantially constant so as to keep a margin between the outermost electron beam and the inner surface of the funnel while LA and SA are reduced so that the index value is reduced. If the yoke mount portion 33 is formed in a perfect pyramid-like shape, the cross-section becomes a rectangle having a long edge L and a short edge S. Where the aspect ratio between the edges is M:N, the following relation exists.

$$(M+N)/(2\times(M^2+N^2))^{1/2} \tag{2}$$

The above index is a form obtained by including reductions of the outer diameters of the yoke mount portion 33 in the horizontal and vertical axes directions. As a result of simulation analysis, even in both of the cases where the outer diameters of the yoke mount portion are reduced only in the horizontal axis direction and where the outer diameters of the yoke mount portion are reduced only in the vertical axis direction, substantially similar results are obtained with respect to reductions of the deflection power. Accordingly, it is not necessary to take only one of LA and SA more significant, but the rectangular level can be expressed by the index described above without problems.

Also, effects of making the cross section of the yoke mount portion 33 to be rectangular shape, depending on the positional difference in the tube axis direction Z are analyzed. As a result, as shown in FIG. 3, it has been found that it is important to form the yoke mount portion 33 in a rectangular shape in the area located between the end 21 of the deflection yoke 20 (or the ends of the deflection coil) on the phosphor screen side and the deflection reference position (which is normally referred to as a reference line) 25 of the electron beams.

As shown in FIGS. 4A and 4B, the deflection reference position is a position O on the tube axis Z, at which the angle between the tube axis Z and a line extending from the end 17*d* of the phosphor screen 17 in the diagonal axis direction to a certain point O is ½ of the maximum deflection angle θ according to regulations concerning a cathode ray tube. The deflection reference position is the center of deflection of electron beams.

FIG. 3 shows a change in the route of the electron beams emitted onto the diagonal end 17*d* of the phosphor screen 17 in case where the deflection coil 20A of the deflection yoke 20 is made approximate to the electron beams in the area 20B hatched by oblique lines. In this case, the deflection magnetic fields are strengthened on the neck side rather than at the deflection reference position 25, and therefore, electron beams are deflected early and collide into the inner wall of the yoke mount portion 33 as indicated by the route 22A. Inversely, if the deflection coil is arranged close to the electron beams 22 in the area on the side of the deflection reference position 25 close to the phosphor screen 17, a clearance increases between the route of the electron beams and the inner wall of the yoke mount portion 33, and accordingly, the neck side of the deflection yoke 20 is extended so that the deflection power can be reduced much more.

Also, in a cathode ray tube apparatus having different neck diameters, the difference in shape of the yoke mount portion occurs substantially within a region from the end of the neck side to the deflection reference position 25, and the shape of the yoke mount portion on the side closer to the phosphor screen than the above region is substantially constant regardless of the neck diameter. Therefore, the analysis result is substantially the same as described above.

In the next, explanation will be made of a reduction effect concerning the deflection power.

Figure 5:
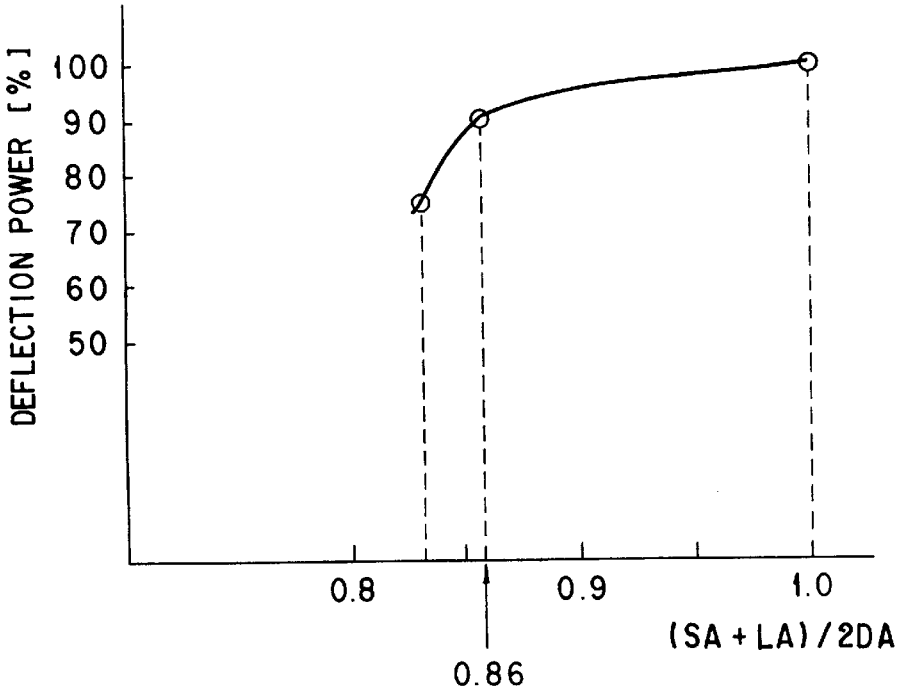

FIG. 5 shows the degree of reduction of the deflection power with respect to an index value of the rectangular level. In this case, the deflection power is calculated where the specifications of the deflection yoke 20 are fixed while the deflection coils and the core are arranged closer to electron beams as the shape of the yoke mount portion 33 approximates to a rectangle. Also, the horizontal deflection power is adopted as the deflection power.

From this figure, it is apparent that the reduction effect concerning the deflection power rapidly appears, and the power is reduced, for example, by 10 to 30%, with respect to the conical yoke mount portion, when the index value is substantially smaller than 0.86. Inversely, when the index value is 0.86 or higher, the reduction effect of the deflection power is only 10% or less. Thus, the deflection power is improved as the yoke mount portion 33 approximates to a truncated quadrangular pyramid-like shape.

Now the strength of the vacuum envelope will be explained.

Figure 6:
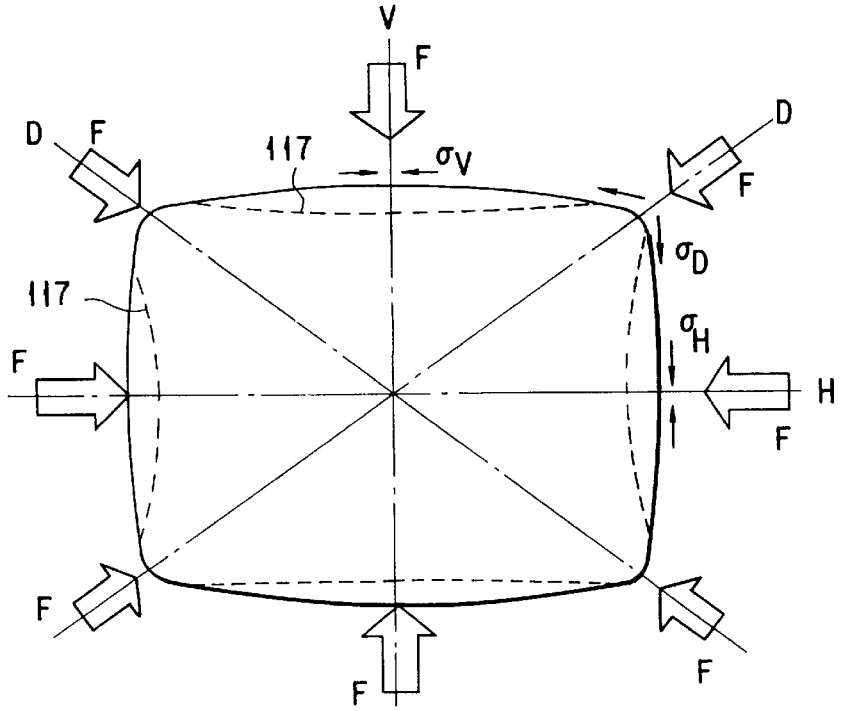

In case of a conical yoke mount portion, its cross-section is perpendicular to the tube axis Z is circular, and therefore, deformation or stresses caused in case of a pyramid-like shape do not appear, so that there is no problem concerning strength. In contrast, in case of a truncated quadrangular pyramid-like yoke mount portion 33, deformation 117 is caused and deterioration of the strength of the vacuum envelope is thereby accompanied due to occurrences of stresses σV, σH, and σD, when the atmospheric pressure F acts as shown in FIG. 6. Thus, there is a problem inherent to a yoke mount portion having a truncated quadrangular pyramid-like shape.

In case of a conventional 1R tube described previously, the yoke mount portion is formed in an insufficiently pyramid-like shape so that the deflection power reduction effect is insufficient, or the vacuum stress is high near the diagonal axis of the yoke mount portion so that sufficient strength cannot be maintained with respect to a flat panel in which the radius of curvature of the outer surface of the panel is twice or more larger than that of the effective diameter of the phosphor screen.

As a result of having analyzed a truncated quadrangular pyramid-like yoke mount portion 33 by calculations and actual measurements, the maximum tolerable stress of the yoke mount portion 33 becomes lower at the region closer to the side of the phosphor screen, in case where the index value of the rectangular level is kept constant. That is, as the position is closer to the phosphor screen, the diameter of the yoke mount portion increases and the length of the edges of the rectangular cross-section of the yoke mount portion increases, resulting in that deformation due to the atmospheric pressure is caused more easily. Consequently, in a yoke mount portion having a truncated quadrangular pyramid-like shape, only the minimum area required for mounting the deflection yoke 20 should be formed to be quite pyramid-like.

Figure 7:
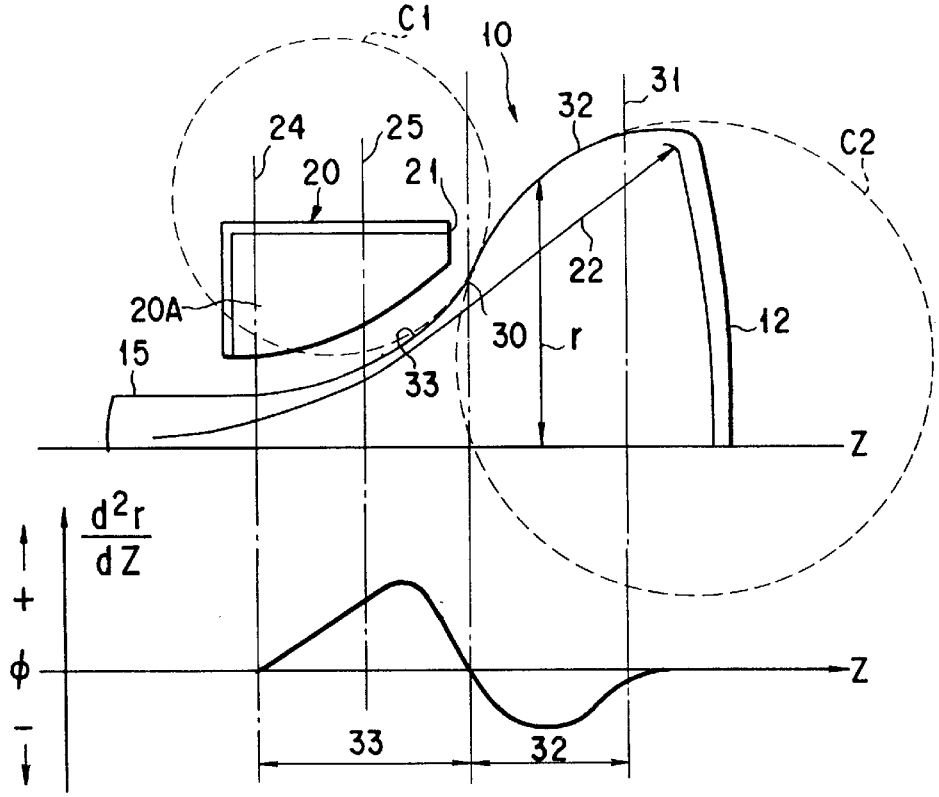

The shape of the funnel will now be explained below. FIG. 7 shows a cross-section in which the vacuum envelope 10 is cut along a plane including the tube axis Z and the diagonal axis D. The panel 12 of the vacuum envelope 10 is connected with the funnel 13 at a joint portion 31, and the funnel 13 and the neck 15 are joined to each other at a joint portion 24. The small diameter portion of the funnel 13 has a shape along the electron beam route 22 toward a diagonal corner end 17*d* of the phosphor screen, thus constructing the yoke mount portion 33.

The electron beam route 22 is deflected by deflection magnetic fields over a wide range and therefore draws a smooth curve. Therefore, the yoke mount portion 33 along the electron beam route 22 has a convex shape projecting toward the tube axis Z such that the value obtained by twice differentiating the funnel diameter r (z) by the tube axis Z is positive. Specifically, the shape of the yoke mount portion 33 can be expressed by using an arc having a center outside the funnel, for example, like a circle C1.

Also, according to the present embodiment, in the funnel 13, the first portion 32 extending from the end of the yoke mount portion (or second portion) 33 on the screen side to the panel 12 has a shape expanded so as to reduce the vacuum stress, for example, a concave shape flared toward the tube axis Z such that the value obtained by twice differentiating the funnel diameter r (z) by the tube axis is negative. The first portion 32 can be expressed by an arc having a center inside the funnel, for example, like a circle C2.

The end of the yoke mount portion 33 on the screen side (e.g., the boundary between the first and second portions 32 and 33) is a position where the yoke mount portion is not along the electron beam route 22, i.e., the position of an inflection point 30 where the value obtained by twice differentiation as described above is zero.

Since a conventional conical yoke mount portion does not particularly suggest a problem of strength, the inflection point exists at a position which is distant by 40 mm to 45 mm from the deflection reference position 25 toward the screen side. The end of the deflection yoke 20 on the screen side exists at a position which is distant by 15 mm to 25 mm from the deflection reference position 25 toward the screen side.

This is mainly because a margin must be maintained to respond to variations of the length of the magnetic passage of the deflection yoke and because it is necessary to maintain a space for receiving a wedge which is inserted between the deflection yoke and the funnel from the end of the deflection yoke on the screen side. Even in a conventional 1R tube, the inflection point 30 exists at a position distant by about 42 mm from the deflection reference position due to the same reason as described above.

The present inventors made a discussion that the inflection point 30 should be shifted to the neck 15 side through calculations and actual measurements. The table cited below shows data concerning vacuum stresses in two types of cathode ray tubes, where the inflection point 30 is shifted to the neck 15 side. Although the numerical values in the table are measured values, calculation values are substantially the same values. The type A relates to a tube having a deflection angle 90° and a neck diameter 29.1 mm, and the type B relates to a tube having a deflection angle 100° and a neck diameter 29.1 mm.

In the following table, the inflection points in the cross section in the diagonal axis direction are indicated by the distance from the deflection reference position. The maximum vacuum stress indicates the maximum value in the entire area of the yoke mount portion, and becomes maximum on the outer surface at that portion of the yoke mount portion which is close to the end of the yoke mount portion on the screen side in the diagonal axis direction. The index values of the rectangular levels in both types are equal to each other.

To set the inflection point, the end position 21 of the deflection yoke 20 on the screen side (where the position of the deflection coil is closest to the screen side) has been previously determined through simulations and actual measurements in case where the deflection power is optimized. The end position 21 of the deflection yoke 20 on the screen side is distant by about 21 mm from the deflection reference position 25 in the type A and by about 19 mm in the type B. The inflection point 30 in the table is set much closer to the screen side than the end position 21 of the deflection yoke 20.

From the following table, it is found that the vacuum stress is rapidly relaxed as the inflection point 30 is shifted to the neck side. A cathode ray tube which has a maximum vacuum stress value of 1200 or less will maintain sufficient strength and will be useful. However, to design an actual commercial product, the funnel having a shorter inflection point distance is selected in order to maintain more securely safety concerning strength. In the type A, although the distance to the inflection point 30 is 37 mm, inflection points in the cross-sections in the horizontal axis direction and in the vertical axis direction are both 32 mm from the deflection reference position 25.

TABLE

| Type A | | Type B | |
|---|---|---|---|
| Inflection point | Maximum vacuum stress | Inflection point | Maximum vacuum stress |
| 43 mm | 1270 psi | 35 mm | 1160 psi |
| 37 mm | 1170 psi | 29 mm | 1000 psi |

By thus shifting the inflection point 30 to the neck 15 side, it is possible to improve the strength of the cathode ray tube having a truncated quadrangular pyramid-like yoke mount portion 33, and reduction of the deflection power and maintenance of bulb strength can both be achieved.

From the results of simulation analysis, in a cathode ray tube having a deflection angle of 90 to 110° and a neck diameter of 22.5 to 36.5 mm, the position of the end 21 of the deflection yoke 20 on the screen side, which optimizes the deflection power, is 10 to 30 mm from the deflection reference position 25. Therefore, for example, the inflection point 30 is set within a distance of 17 mm or less from the end 21 of the deflection yoke in the screen side, and preferably within a distance of 15 mm or less therefrom. Otherwise, the inflection point 30 is set within a distance of 37 mm or less from the deflection reference position 25, and preferably within a distance of 35 mm or less therefrom. In this manner, it is possible to provide a cathode ray tube comprising a substantially truncated quadrangular pyramid-like yoke mount portion with more excellent strength and with improved effect of reducing the deflection power.

In this case, the bulb strength can be improved efficiently, by slightly lowering the rectangular level to relax the stress, in the first portion of the funnel 13 which is closer to the phosphor screen than the yoke mount portion 33. More specifically, the bulb strength can be efficiently improved, by setting the inflection points in the horizontal axis direction and in the vertical axis direction, to be closer to the phosphor screen than the inflection points in the diagonal axis directions.

EXAMPLE 1

Figure 8:
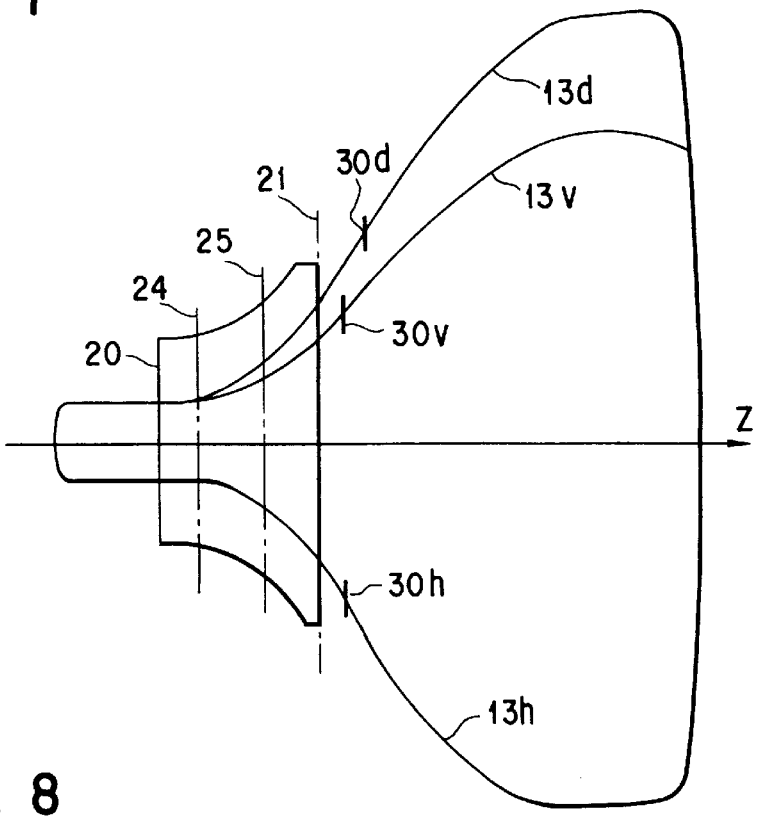

FIG. 8 shows an Example 1 of the present invention. In this figure, numerals 13*d*, 13*h*, and 13*v* denote contour curves of cross-sections of a funnel where the funnel is cut along a plane including the tube axis Z and the diagonal axis D, a plane including the tube axis Z and the horizontal axis H, and a plane including the tube axis Z and the vertical axis V, respectively.

In the Example 1, the present invention is applied to a cathode ray tube having a neck diameter 29.1 mm and a deflection angle 90°. That is, coordinates of inflection points 30*d*, 30*h*, and 30*v* in the cross-sections are respectively set to 37 mm, 32 mm, and 32 mm from the deflection reference point 25 in the tube axis direction. In the deflection yoke 20, the coordinate of the end 21 of the deflection coil on the screen side is 21 mm from the deflection reference point 25 in the tube axis direction. In this case, the maximum vacuum stress is reduced to 1170 psi.

DA, LA, and SA in a cross-section perpendicular to the tube axis Z at the deflection reference position 25 are respectively 28.4 mm, 25.2 mm, and 21.0 mm, and the index value of the rectangular level is 0.81. The deflection power is reduced by about 25% compared with a funnel having a conical yoke mount portion.

Further, in the Example 1, in the overall area from the yoke mount portion 33 to the entire funnel 13, i.e., in that area of the funnel which is more closer to the screen side than the deflection reference position 25, the cross-section of the funnel perpendicular to the tube axis Z is not a circle and satisfies the following relation.

$$DA>LA \text{ or } DA>SA$$

EXAMPLE 2

In an Example 2, the present invention is applied to a cathode ray tube having a neck diameter 29.1 mm and a deflection angle 100°. That is, like in the Example 1, coordinates of the inflection points 30*d*, 30*h*, and 30*v* in the cross-sections are respectively set to 29 mm, 31 mm, and 34 mm from the deflection reference point 25 in the tube axis direction. In the deflection yoke 20, the coordinate of the end 21 of the deflection coil on the screen side is 19 mm from the deflection reference point 25 in the tube axis direction. In this manner, the maximum vacuum stress of the vacuum envelope is reduced to 1000 psi.

DA, LA, and SA in a cross-section perpendicular to the tube axis Z at the deflection reference position 25 are respectively 29.9 mm, 26.7 mm, and 22.3 mm, and the index value of the rectangular level is 0.82. The deflection power is reduced by about 22% compared with a funnel having a conical yoke mount portion.

Also, in the Example 2, in the overall area from the yoke mount portion 33 to the entire funnel 13, i.e., in that area of the funnel which is more closer to the screen side than the deflection reference position 25, the cross-section of the funnel perpendicular to the tube axis Z is not a circle and satisfies the following relation.

$$DA>LA \text{ or } DA>SA$$

In a cathode ray tube according to the embodiments constructed as described above, the atmospheric pressure strength of the vacuum envelope can be sufficiently maintained and the deflection power can be efficiently reduced, even if the yoke mount portion is formed in a substantially truncated quadrangular pyramid-like shape. Thus, it is possible to provide a cathode ray tube which satisfies requests for high luminance and high-frequency deflection.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cathode ray tube comprising:

a vacuum envelope made of glass, said vacuum envelope including a substantially rectangular panel having an inner surface on which a substantially rectangular phosphor screen is formed, the phosphor screen having a horizontal axis and a vertical axis passing through a tube axis said horizontal and vertical axes being perpendicular to each other, a substantially cylindrical neck, and a funnel connected between the neck and the panel and having a first portion positioned on a side of the panel and a substantially truncated quadrangular pyramid-like second portion positioned on a side of the neck, at least one cross-section perpendicular to the tube axis of the second portion having a non-circular shape which maximizes a distance from the tube axis, the panel, the funnel, and the neck being disposed along the tube axis at a portion between the horizontal axis and the vertical axis;

an electron gun arranged in the neck, for emitting electron beams to the phosphor screen; and a deflection yoke mounted on an outer surface of the vacuum envelope to extend from the second portion of the funnel to the neck, and having a deflection coil for deflecting the electron beams emitted from the electron gun to scan the phosphor screen;

wherein, in a cross-section of the vacuum envelope cut along a plane including the tube axis, the first portion of the funnel has a concave shape which provides a negative value by twice differentiating r(z) by a tube-axis coordinate z and the second portion of the funnel has a convex shape which projects toward the tube-axis and provides a positive value by twice differentiating r(z) by the tube-axis coordinate z, where the tube-axis coordinate z is given in a direction in which the phosphor screen side is positive along the tube-axis and a distance between the tube axis and the outer surface of the funnel is r(z), wherein a boundary between the second and first portions of the funnel is an inflection point which provides a value of zero by twice differentiating r(z) by the tube-axis coordinate z, and wherein, in a cross-section of the vacuum envelope cut along the plane including the tube axis, the boundary between the second and first portions of the funnel is within a range of at most 17 mm from the tube axis coordinate of the end of the deflection coil on the side of the phosphor screen.

2. A cathode ray tube comprising:

a vacuum envelope made of glass, said vacuum envelope including:

a substantially rectangular panel having an inner surface on which a substantially rectangular phosphor screen is formed, the phosphor screen having a horizontal axis and a vertical axis passing through a tube axis, said horizontal and vertical axes being perpendicular to each other, a substantially cylindrical neck, and a funnel connected between the neck and the panel and having a first portion positioned on a side of the panel and a substantially truncated quadrangular pyramid-like second portion positioned on a side of the neck, at least one cross-section perpendicular to the tube axis of the second portion having a non-circular shape which maximizes a distance from the tube axis, the panel, the funnel, and the neck being disposed along the tube axis at a portion between the horizontal axis and the vertical axis, an electron gun arranged in the neck, configured to emit electron beams to the phosphor screen; and a deflection yoke mounted on an outer surface of the vacuum envelope to extend from the second portion of the funnel to the neck, and having a deflection coil configured to deflect the electron beams emitted from the electron gun to scan the phosphor screen;

wherein, in a cross-section of the vacuum envelope cut along a plane including the tube axis, the first portion of the funnel has a concave shape which provides a negative value by twice differentiating r(z) by a tube-axis coordinate z and the second portion of the funnel has a convex shape which projects toward the tube axis and provides a positive value by twice differentiating r(z) by the tube-axis coordinate z, where the tube-axis coordinate z is given in a direction in which the phosphor screen side is positive along the tube axis and a distance between the tube axis and the outer surface of the funnel is r(z), wherein a boundary between the second and first portions of the funnel is an inflection point which provides a value of zero by twice differentiating r(z) by the tube-axis coordinate z, and wherein the tube axis coordinate of the boundary position between the second and first portions is within a range of at most 37 mm from the tube axis coordinate of a deflection reference position, where the deflection reference position is a point on the tube axis, at which an angle between the tube axis and a line connecting an end of the phosphor screen in a diagonal axis direction thereof, with the tube axis between the phosphor screen and the electron gun is ½ of a maximum deflection angle of the cathode ray tube.

3. A cathode ray tube according to claim 1, wherein the tube axis coordinate of the boundary position between the second and first portions is within a range of at most 37 mm from the tube axis coordinate of a deflection reference position, where the deflection reference position is a point on the tube axis, at which an angle between the tube axis and a line connecting an end of the phosphor screen in a diagonal axis direction thereof, with the tube axis between the phosphor screen and the electron gun is ½ of a maximum deflection angle of the cathode ray tube.

4. A cathode ray tube comprising:

a vacuum envelope made of glass and including a substantially rectangular panel having an inner surface on which a substantially rectangular phosphor screen is formed, the phosphor screen having a horizontal axis and a vertical axis passing through a tube axis and being perpendicular to each other, a substantially cylindrical neck, a funnel connected between the neck and the panel and having a first portion positioned on a side of the panel and a substantially truncated quadrangular pyramid-like second portion positioned on a side of the neck, the panel, the funnel, and the neck being disposed along the tube axis;

an electron gun arranged in the neck, for emitting electron beams to the phosphor screen; and a deflection yoke mounted on an outer surface of the vacuum envelope to extend from the second portion of the funnel to the neck, and having a deflection coil for deflecting the electron beams emitted from the electron gun to scan the phosphor screen;

wherein a deflection reference position is a point on the tube axis, at which an angle between the tube axis and a line connecting an end of the phosphor screen in a diagonal axis direction thereof, with the tube axis between the phosphor screen and the electron gun is ½ of a maximum deflection angle of the cathode ray tube, and LA, SA, and DA are respectively diameters of the cross-section in the horizontal axis direction, the vertical axis direction, and the diagonal axis direction of the phosphor screen, wherein all of the cross-sections of the funnel perpendicular to the tube axis positioned between a deflection reference position to the boundary position between the second and first portions satisfy a relation of DA>LA or DA>SA, and the boundary position between the second and first portions is within a range of at most 37 mm from the deflection reference position along the tube axis.

5. A cathode ray tube according to claim 4, wherein the boundary position between the second and first portions is within a range of 37 mm from the deflection reference position along the tube axis.

* * * * *